US012187485B1

(12) United States Patent
Ringer

(10) Patent No.: US 12,187,485 B1
(45) Date of Patent: Jan. 7, 2025

(54) BASKET WITH FOREARM GRIP

(71) Applicant: Derek Ringer, Brownsburg, IN (US)

(72) Inventor: Derek Ringer, Brownsburg, IN (US)

( * ) Notice: Subject to any disclaimer, the term of this patent is extended or adjusted under 35 U.S.C. 154(b) by 34 days.

(21) Appl. No.: 18/124,053

(22) Filed: Mar. 21, 2023

(51) Int. Cl.
*B65D 1/38* (2006.01)

(52) U.S. Cl.
CPC ..... *B65D 1/38* (2013.01); *B65D 2525/281* (2013.01)

(58) Field of Classification Search
CPC ... D06F 95/002; B65D 1/38; B65D 2525/281; B65D 25/2832; B65D 25/2805; B65D 25/2811; B65D 25/282
USPC ..... 220/659, 696, 752, 769, 770, 771, 772, 220/914
See application file for complete search history.

(56) References Cited

U.S. PATENT DOCUMENTS

| | | | | |
|---|---|---|---|---|
| 3,545,462 | A | 12/1970 | O'Mahoney | |
| 5,127,536 | A * | 7/1992 | Cohen | B65D 33/105 383/18 |
| 6,039,205 | A | 3/2000 | Flink | |
| D425,275 | S * | 5/2000 | Delouvre | D32/37 |
| 7,207,460 | B2 * | 4/2007 | Sander | D06F 95/002 220/676 |
| 10,183,795 | B2 | 1/2019 | Gamble | |
| D945,107 | S | 3/2022 | Abadia | |
| 2009/0058025 | A1 | 3/2009 | Oliveira | |
| 2009/0224017 | A1 | 9/2009 | Hudson | |
| 2010/0155434 | A1 | 6/2010 | Bradford | |
| 2021/0053726 | A1 * | 2/2021 | Hasani | A47G 19/2205 |

OTHER PUBLICATIONS

"Prism," The Concise Oxford Dictionary of Mathematics (4 ed.), 2013, Oxford University Press (Year: 2013).*
"Congruent Figures," The Concise Oxford Dictionary of Mathematics (4 ed.), 2013, Oxford University Press (Year: 2013).*
"Similar," The Concise Oxford Dictionary of Mathematics (4 ed.), 2013, Oxford University Press (Year: 2013).*

* cited by examiner

*Primary Examiner* — Nathan J Jenness
*Assistant Examiner* — Laura E. Parker
(74) *Attorney, Agent, or Firm* — Kyle A. Fletcher, Esq.

(57) ABSTRACT

The basket with forearm grip is a container. The basket with forearm grip is adapted for use with an individual. The basket with forearm grip is carried by the individual. The basket with forearm grip is secured to one or more forearms of the individual. By forearm is meant the region from the elbow to the wrist of the individual. The basket with forearm grip includes a basket structure and a plurality of prismatic bifurcations. The plurality of prismatic bifurcations attaches to the basket structure. The basket structure contains goods that are carried by the individual using the basket with forearm grip. The plurality of prismatic bifurcations allows the individual carrying the basket with forearm grip to transfer a portion of the load of the goods contained in the basket structure to the skeletal structure of the individual. This transfer to the skeletal structure reduces muscle fatigue.

11 Claims, 5 Drawing Sheets

BASKET WITH FOREARM GRIP

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of shopping baskets. (A45C3/04)

SUMMARY OF INVENTION

The basket with forearm grip is a container. The basket with forearm grip is adapted for use with an individual. The basket with forearm grip is carried by the individual. The basket with forearm grip is secured to one or more forearms of the individual. By forearm is meant the region from the elbow to the wrist of the individual. The basket with forearm grip comprises a basket structure and a plurality of prismatic bifurcations. The plurality of prismatic bifurcations attaches to the basket structure. The basket structure contains goods that are carried by the individual using the basket with forearm grip. The plurality of prismatic bifurcations are roughly geometrically similar to a forearm of the individual. The plurality of prismatic bifurcations are sized such that each forearm of the individual can insert into a prismatic bifurcation selected from the plurality of prismatic bifurcations. The plurality of prismatic bifurcations allows the individual carrying the basket with forearm grip to transfer a portion of the load of the goods contained in the basket structure to the skeletal structure of the individual. This transfer to the skeletal structure reduces muscle fatigue.

These together with additional objects, features and advantages of the basket with forearm grip will be readily apparent to those of ordinary skill in the art upon reading the following detailed description of the presently preferred, but nonetheless illustrative, embodiments when taken in conjunction with the accompanying drawings.

In this respect, before explaining the current embodiments of the basket with forearm grip in detail, it is to be understood that the basket with forearm grip is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the basket with forearm grip.

It is therefore important that the claims be regarded as including such equivalent construction insofar as they do not depart from the spirit and scope of the basket with forearm grip. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
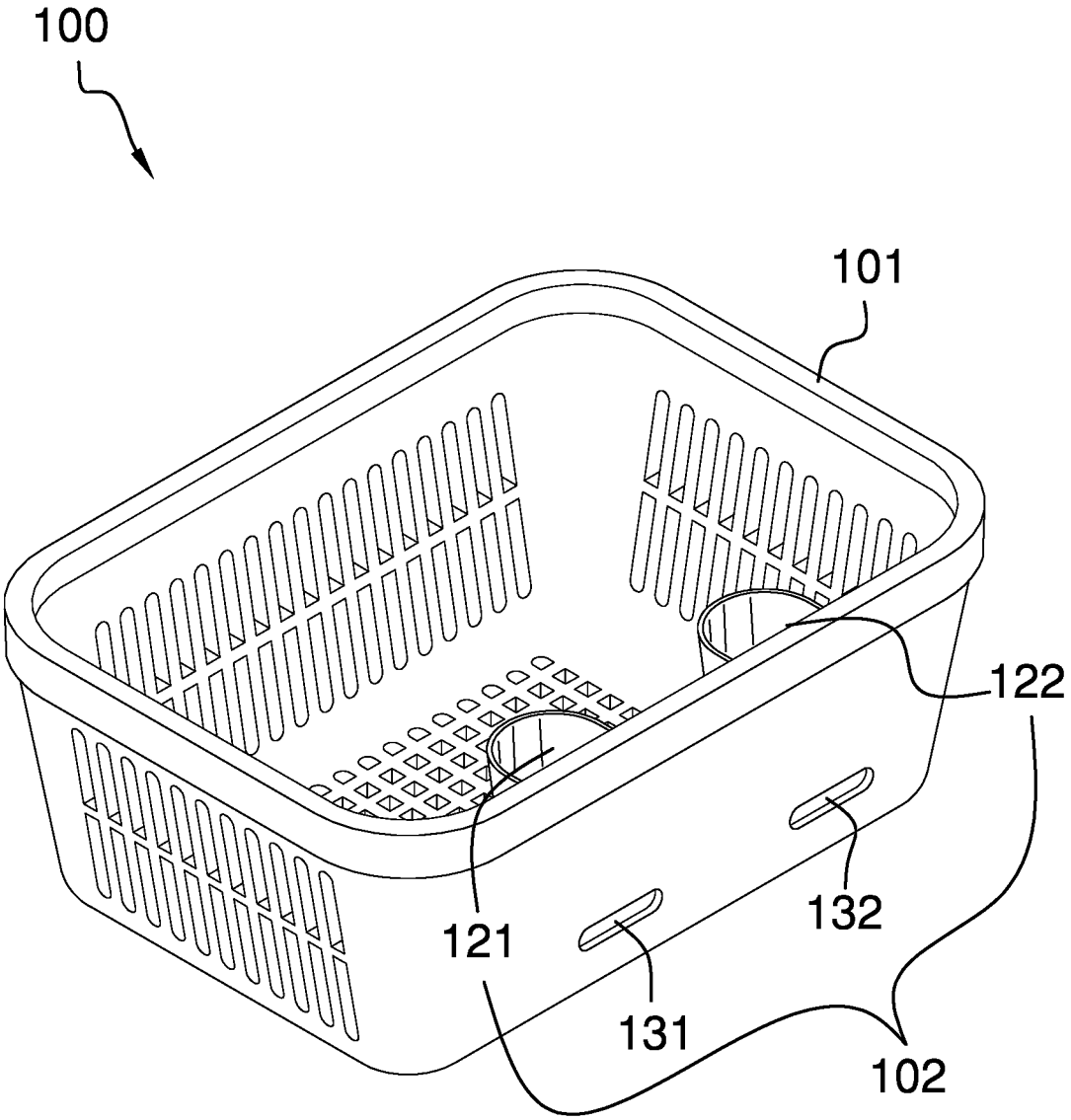
FIG. 1 is a perspective view of an embodiment of the disclosure.
Figure 2:
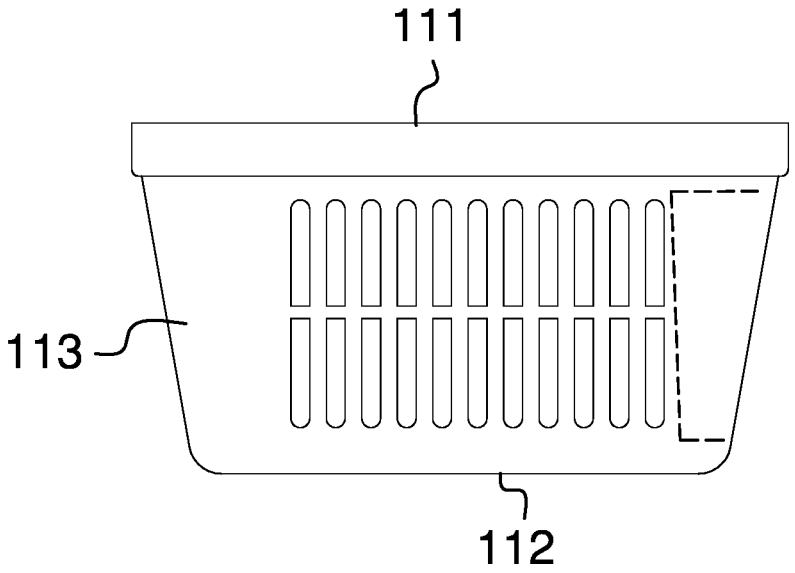
FIG. 2 is a side view of an embodiment of the disclosure.
Figure 3:
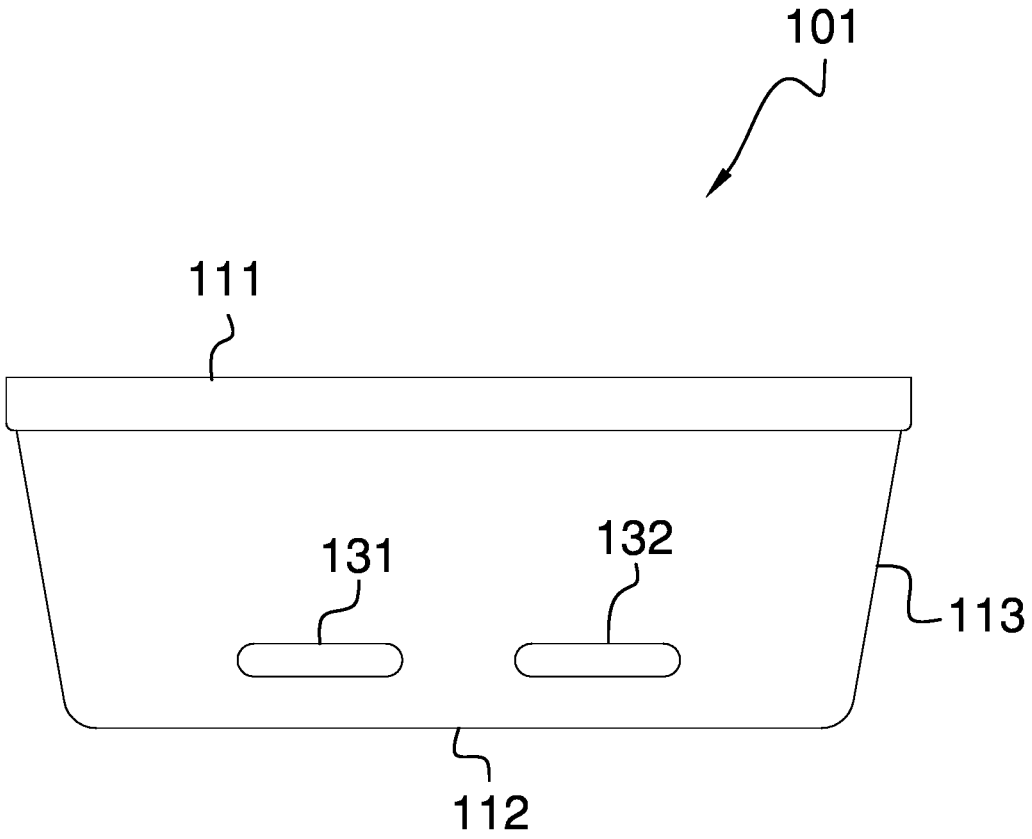
FIG. 3 is a front view of an embodiment of the disclosure.
Figure 4:
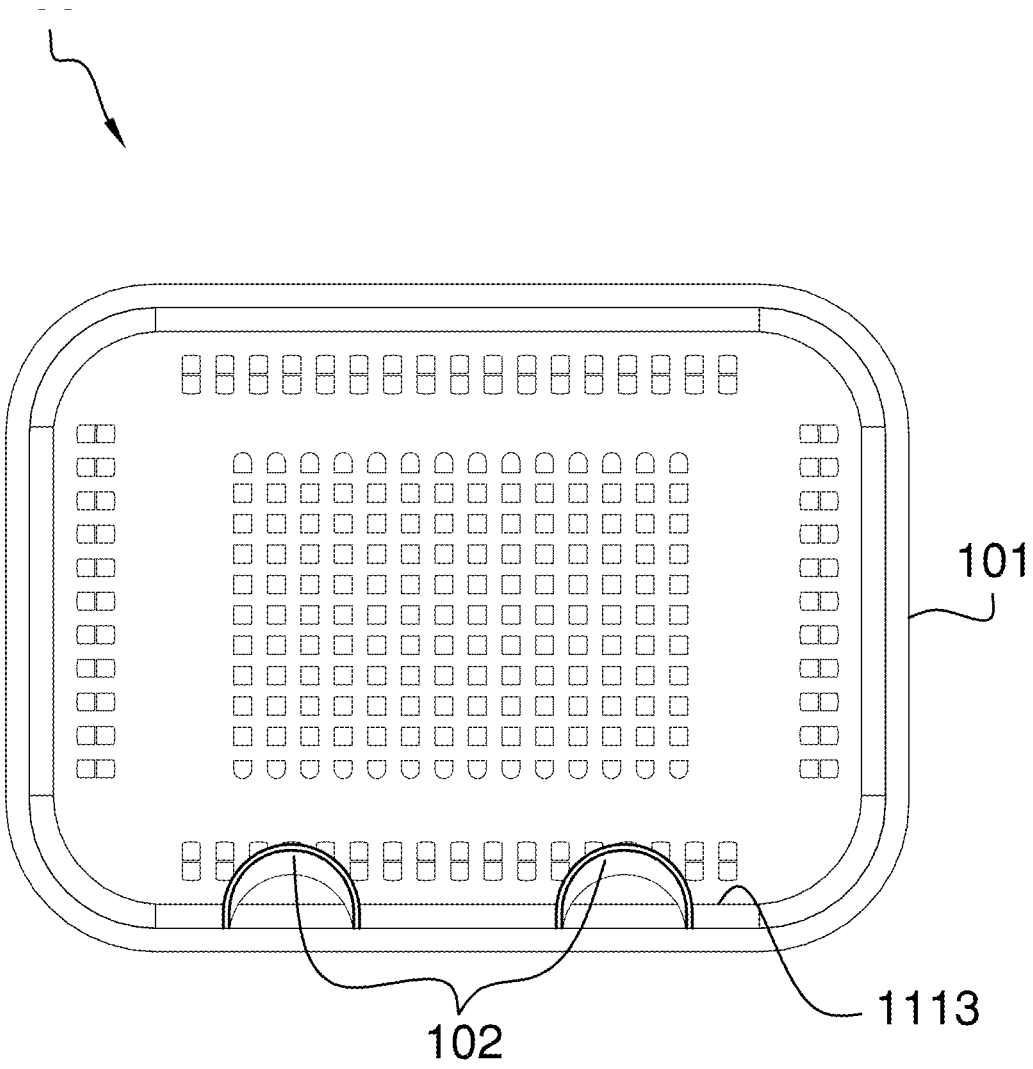
FIG. 4 is a rear view of an embodiment of the disclosure.
Figure 5:
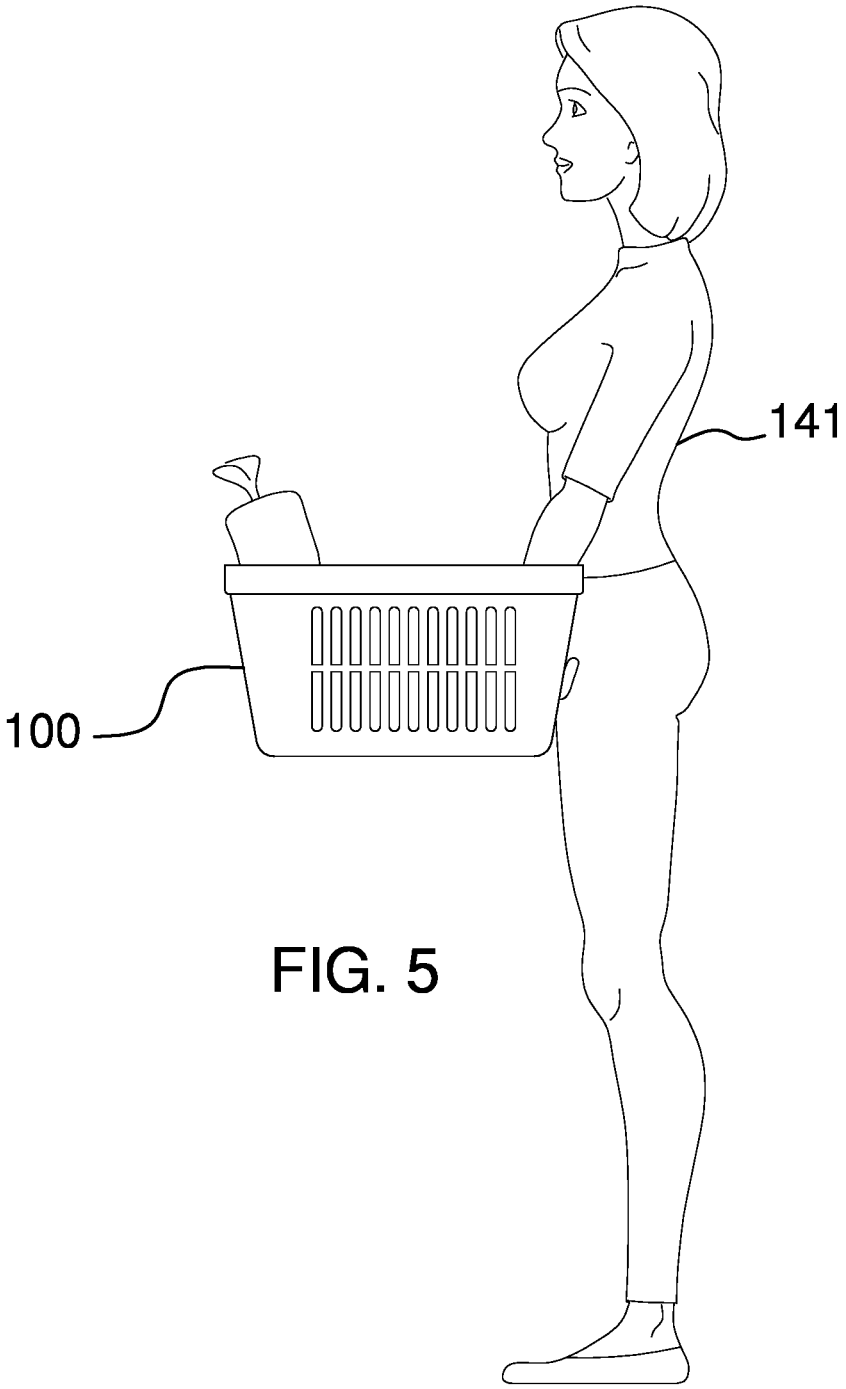
FIG. 5 is an in-use view of an embodiment of the disclosure.

Detailed reference will now be made to one or more potential embodiments of the disclosure, which are illustrated in FIGS. 1 through 5.

The basket with forearm grip 100 (hereinafter invention) is a container. The invention 100 is adapted for use with an individual 141. The invention 100 is carried by the individual 141. The invention 100 is secured to one or more forearms of the individual 141. By forearm is meant the region from the elbow to the wrist of the individual 141. The invention 100 comprises a basket structure 101 and a plurality of prismatic bifurcations 102. The plurality of prismatic bifurcations 102 attaches to the basket structure 101. The basket structure 101 contains goods that are carried by the individual 141 using the invention 100. The plurality of prismatic bifurcations 102 are roughly geometrically similar to a forearm of the individual 141. The plurality of prismatic bifurcations 102 are sized such that each forearm of the individual 141 can insert into a prismatic bifurcation selected from the plurality of prismatic bifurcations 102. The plurality of prismatic bifurcations 102 allows the individual 141 carrying the invention 100 to transfer a portion of the load of the goods contained in the basket structure 101 to the skeletal structure of the individual 141. This transfer to the skeletal structure reduces muscle fatigue.

The basket structure 101 is a containment structure. The basket structure 101 is a prism shaped structure. The basket structure 101 has a pan shape. The goods carried by an individual 141 carrying the invention 100 are placed into the basket structure 101. The plurality of prismatic bifurcations 102 forms a structure used to carry the basket structure 101. The basket structure 101 comprises an open face 111, a closed face 112, and a plurality of lateral faces 113.

The open face 111 is the open face 111 of the pan shape of the basket structure 101. The open face 111 provides access to the containment space formed by the basket structure 101. The open face 111 forms the superior surface of the basket structure 101. The open face 111 is defined elsewhere in this disclosure. The closed face 112 is the closed face 112 of the pan shape of the basket structure 101.

The closed face 112 provides the horizontally oriented boundary of the containment space of the basket structure 101. The closed face 112 forms the load bearing structure that elevates the goods stored in the basket structure 101 above a supporting surface. The closed face 112 forms the inferior surface of the basket structure 101. The closed face 112 is defined elsewhere in this disclosure.

The plurality of lateral faces 113 form the lateral face structure of the pan shape of the basket structure 101. The plurality of lateral faces 113 form the vertically oriented boundaries of the containment space formed by the basket structure 101. The plurality of prismatic bifurcations 102 attach to the interior surface of the lateral face selected from the plurality of lateral faces 113 with the greatest surface area. The lateral face is defined elsewhere in this disclosure.

The plurality of prismatic bifurcations 102 attach to an interior surface 1113 of the lateral face selected from the plurality of lateral faces 113 of the basket structure 101 with the greatest surface area. The attachment of the plurality of prismatic bifurcations 102 to the basket structure 101 is such that the forearms of the individual 141 carrying the invention insert into a prismatic bifurcation selected from the plurality of prismatic bifurcation 102 through the open face 111 of the basket structure 101. The position of the plurality of prismatic bifurcations 102 on the interior surface of the selected lateral face ensures that the force of gravity rotates the basket structure 101 such that the selected lateral face rotates into the forearm of the individual 141 carrying the invention 100. This positioning of the plurality of prismatic bifurcations 102 ensures that a portion of the load of the basket structure 101 transfers to the skeletal structure of the individual 141.

The plurality of prismatic bifurcations 102 comprises a first prismatic bifurcation 121 and a second prismatic bifurcation 122.

The first prismatic bifurcation 121 is a tubular structure. The first prismatic bifurcation 121 is formed as a prismatic bifurcation. The prismatic bifurcation is defined elsewhere in this disclosure. The first prismatic bifurcation 121 attaches to the interior surface of the lateral face selected from the plurality of lateral faces 113 with the greatest surface area. The bifurcated edges of the lateral face of the first prismatic bifurcation 121 attach to the selected lateral face. The first prismatic bifurcation 121 is oriented on the basket structure 101 such that the cant between the center axis of the first prismatic bifurcation 121 and the force of gravity is at a minimum when the closed face 112 of the basket structure 101 rests on a horizontal surface.

The second prismatic bifurcation 122 is a tubular structure. The second prismatic bifurcation 122 is formed as a prismatic bifurcation. The prismatic bifurcation is defined elsewhere in this disclosure. The second prismatic bifurcation 122 attaches to the interior surface of the same lateral face that was selected for the first prismatic bifurcation 121. The bifurcated edges of the lateral face of the second prismatic bifurcation 122 attach to the selected lateral face. The second prismatic bifurcation 122 is oriented on the basket structure 101 such that the center axis of the second prismatic bifurcation 122 is parallel to the center axis of the first prismatic bifurcation 121.

The plurality of lateral faces 113 further comprises a first handle slot 131 and a second handle slot 132.

The first handle slot 131 is a negative space that is formed through the lateral face selected from the plurality of lateral faces 113 with the greatest surface area. The position of the first handle slot 131 is inferior to the position of the inferior congruent end of the tubular structure of the first prismatic bifurcation 121. The first handle slot 131 is positioned such that the fingers of the hand of the individual carrying the invention 100 can insert through the first handle slot 131 after the forearm is inserted into the first prismatic bifurcation 121. The first handle slot 131 forms a grip that allows the individual 141 carrying the invention 100 to grasp the basket structure 101.

The second handle slot 132 is a negative space that is formed through the lateral face selected from the plurality of lateral faces 113 with the greatest surface area. The position of the second handle slot 132 is inferior to the position of the inferior congruent end of the tubular structure of the second prismatic bifurcation 122. The second handle slot 132 is positioned such that the fingers of the hand of the individual 141 carrying the invention 100 can insert through the second handle slot 132 after the forearm is inserted into the second prismatic bifurcation 122. The second handle slot 132 forms a grip that allows the individual 141 carrying the invention 100 to grasp the basket structure 101.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Cant: As used in this disclosure, a cant is an angular deviation from one or more reference lines (or planes) such as a vertical line (or plane) or a horizontal line (or plane).

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Elevation: As used in this disclosure, elevation refers to the span of the distance in the superior direction between a specified horizontal surface and a reference horizontal surface. Unless the context of the disclosure suggest otherwise, the specified horizontal surface is the supporting surface the potential embodiment of the disclosure rests on. The infinitive form of elevation is to elevate.

Exterior: As used in this disclosure, the exterior is used as a relational term that implies that an object is not contained within the boundary of a structure or a space.

Force: As used in this disclosure, a force refers to a net (or unopposed) measurable interaction that changes the direction of motion of an object, the velocity of motion of an object, the momentum of an object, or the stress within an object. The term work refers to a measure of the amount of energy that is transferred through the application of a force over a distance. The term power refers to a measure of the amount of energy that is transferred over a period of time.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1. By the term essentially geometrically similar is meant that the primary shapes of two objects are geometrically similar except that there are functional items (such as fastening devices) associated with the primary shape may not maintain the ratio for geometric similarity. By the term roughly geometrically similar is meant that the form factors between the primary shape of the two objects can vary by a factor of up to 10% when the two objects are normalized to be roughly geometrically identical.

Grip: As used in this disclosure, a grip is an accommodation formed on or within an object that allows the object to be grasped or manipulated by a hand.

Handle: As used in this disclosure, a handle is an object by which a tool, object, or door is held or manipulated with the hand.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inferior: As used in this disclosure, the term inferior refers to a directional reference that is parallel to and in the same direction as the force of gravity when an object is positioned or used normally.

Interior: As used in this disclosure, the interior is used as a relational term that implies that an object is contained within the boundary of a structure or a space.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Negative Space: As used in this disclosure, negative space is a method of defining an object through the use of open or empty space as the definition of the object itself, or, through the use of open or empty space to describe the boundaries of an object.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan are open.

Perimeter: As used in this disclosure, a perimeter is one or more curved or straight lines that bounds an enclosed area on a plane or surface. The perimeter of a circle is commonly referred to as a circumference.

Primary Shape: As used in this disclosure, the primary shape refers to a description of the rough overall geometric shape of an object that is assembled from multiple components or surfaces. Use Roughly Primary Structure: As used in this disclosure, a primary structure refers to the component of an object that the other components attach to. The primary structure is also called the base structure.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Prismatic Bifurcation: As used in this disclosure, a prismatic bifurcation refers to the bifurcation of a prism structure by a plane wherein the bifurcating plane is does not intersect the center axis of the prism structure. In a prismatic bifurcation, the center axis can lie on the bifurcating plane. In this instance, the prismatic bifurcation is said to form a horizontal segment.

Rigid Structure: As used in this disclosure, a rigid structure is a solid structure formed from an inelastic material that resists changes in shape. A rigid structure will permanently deform as it fails under a force. See bimodal flexible structure.

Rotation: As used in this disclosure, rotation refers to the cyclic movement of an object around a fixed point or fixed axis. The verb of rotation is to rotate.

Semi-Rigid Structure: As used in this disclosure, a semi-rigid structure is a solid structure that is stiff but not wholly inflexible and that will deform under force before breaking. A semi-rigid structure may or may not behave with an elastic nature in that a semi-rigid structure need not return to its relaxed shape.

Slot: As used in this disclosure, a slot is a long narrow cavity or aperture that is formed in or through an object.

Stanchion: As used in this disclosure, a stanchion refers to a vertically oriented prism-shaped pole, post, or support.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load of the object is transferred. This disclosure assumes that an object placed on the supporting surface is in an orientation that is appropriate for the normal or anticipated use of the object.

Torque: As used in this disclosure, a torque refers to a force that causes an object to rotate.

Tube: As used in this disclosure, the term tube is used to describe a hollow prism-shaped device with two congruent open ends. While tubes that are suitable for use in this disclosure are often used to transport or conveys fluids or gases, the purpose of the tubes in this disclosure are structural. In this disclosure, the terms inner dimension and outer dimension of a tube are used as they would be used by those skilled in the plumbing arts.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A basket with forearm grip comprising a basket structure and a plurality of prismatic members;

wherein the plurality of prismatic members attaches to the basket structure;

wherein the basket structure comprises an open face, a closed face, and a plurality of lateral faces;

wherein the plurality of prismatic members attach to an interior surface of the lateral face selected from the plurality of lateral faces of the basket structure with the greatest surface area;

wherein the attachment of the plurality of prismatic members to the basket structure is adapted to be such that the forearms of the individual carrying the basket with forearm grip insert into a prismatic member selected from the plurality of prismatic members through the open face of the basket structure;

wherein a position of the plurality of prismatic members on the interior surface of the selected lateral face ensures that the force of gravity rotates the basket structure such that the selected lateral face is adapted to rotate into the forearm of the individual carrying the basket with forearm grip.

2. The basket with forearm grip according to claim 1 wherein the basket with forearm grip is a container;

wherein the basket with forearm grip is adapted for use with an individual;

wherein the basket with forearm grip is adapted to be carried by the individual;

wherein the basket with forearm grip is adapted to be carried by securement with one or more forearms of the individual.

3. The basket with forearm grip according to claim 2 wherein the basket structure is a containment structure;

wherein the basket structure contains goods that are adapted to be carried by the individual using the basket with forearm grip;

wherein the plurality of prismatic members are adapted to be sized such that each forearm of the individual can insert into a prismatic member selected from the plurality of prismatic members.

4. The basket with forearm grip according to claim 3 wherein the open face is the open face of the basket structure;

wherein the open face provides access to the containment space formed by the basket structure;

wherein the open face forms the superior surface of the basket structure;

wherein the closed face provides the horizontally oriented boundary of the containment space of the basket structure;

wherein the closed face elevates the goods stored in the basket structure above a supporting surface; wherein the closed face forms the inferior surface of the basket structure;

wherein the plurality of lateral faces form the lateral face structure of the basket structure.

5. The basket with forearm grip according to claim 4 wherein the plurality of prismatic members comprises a first prismatic member and a second prismatic member;

wherein the first prismatic member attaches to the interior surface of the lateral face selected from the plurality of lateral faces with the greatest surface area;

wherein the second prismatic member attaches to the interior surface of the same lateral face that was selected for the first prismatic member.

6. The basket with forearm grip according to claim 5 wherein the edges of the lateral face of the first prismatic member attach to the selected lateral face.

7. The basket with forearm grip according to claim 6 wherein the edges of the lateral face of the second prismatic member attach to the selected lateral face.

8. The basket with forearm grip according to claim 7 wherein the first prismatic member is oriented on the basket structure such that the cant between the center axis of the first prismatic member and the force of gravity is at a minimum when the closed face of the basket structure rests on a horizontal surface;

wherein the second prismatic member is oriented on the basket structure such that the center axis of the second prismatic member is parallel to the center axis of the first prismatic member.

9. The basket with forearm grip according to claim 8 wherein the plurality of lateral faces further comprises a first handle slot and a second handle slot;

wherein the first handle slot is a negative space that is formed through the lateral face selected from the plurality of lateral faces with the greatest surface area;

wherein the second handle slot is a negative space that is formed through the lateral face selected from the plurality of lateral faces with the greatest surface area.

10. The basket with forearm grip according to claim 9 wherein the position of the first handle slot is inferior to the position of the inferior congruent end of the tubular structure of the first prismatic member;

wherein the first handle slot forms a grip that allows the individual carrying the basket with forearm grip to grasp the basket structure;

wherein the position of the second handle slot is inferior to the position of the inferior congruent end of the tubular structure of the second prismatic member;

wherein the second handle slot forms a grip that allows the individual carrying the basket with forearm grip to grasp the basket structure.

11. The basket with forearm grip according to claim 10 wherein the first handle slot is positioned such that the fingers of the hand of the individual carrying the basket with forearm grip can insert through the first handle slot after the forearm is inserted into the first prismatic member;

wherein the second handle slot is positioned such that the fingers of the hand of the individual carrying the basket with forearm grip can insert through the second handle slot after the forearm is inserted into the second prismatic member.

* * * * *